US005983961A

United States Patent [19]

Boellmann

[11] Patent Number: 5,983,961

[45] Date of Patent: Nov. 16, 1999

[54] APPARATUS FOR FILLING A PLURALITY OF CONTAINERS WITH PARTICULATE OR GRANULAR MATERIAL

[75] Inventor: Horst E. Boellmann, Riverside, N.J.

[73] Assignee: Per-Fil Industries, Inc., Riverside, N.J.

[21] Appl. No.: 09/052,078

[22] Filed: Mar. 31, 1998

Related U.S. Application Data

[60] Provisional application No. 60/042,844, Mar. 31, 1997.

[51] Int. Cl.[6] ..... B65B 43/42

[52] U.S. Cl. ..... 141/172; 141/156; 141/177

[58] Field of Search ..... 141/129, 156, 141/157, 172, 177, 181, 183, 237, 256, 257; 222/226, 229, 412, 413

[56] References Cited

U.S. PATENT DOCUMENTS

| | | | |
|---|---|---|---|
| 1,401,401 | 12/1921 | Hartman . | |
| 1,987,580 | 1/1935 | Schneider | 226/26 |
| 2,082,567 | 5/1937 | Bleam | 141/156 |
| 2,241,672 | 8/1941 | Minard | 141/98 |
| 2,768,656 | 6/1956 | Day et al. | 141/80 |
| 2,820,579 | 1/1958 | Roth | 222/440 |
| 2,975,809 | 3/1961 | Ninneman et al. | 141/1 |
| 3,369,578 | 2/1968 | Lampert | 141/235 |
| 3,693,674 | 9/1972 | Guyonnet | 141/242 |
| 4,055,202 | 10/1977 | Greene | 141/59 |
| 4,640,322 | 2/1987 | Ballester | 141/172 |
| 5,154,212 | 10/1992 | Weber | 141/353 |
| 5,188,156 | 2/1993 | Littlepage | 141/98 |
| 5,353,850 | 10/1994 | Ueda et al. | 141/129 |
| 5,377,727 | 1/1995 | Ueda et al. | 141/178 |

*Primary Examiner*—Henry J. Recla
*Assistant Examiner*—Khon Huynh
*Attorney, Agent, or Firm*—Norman E. Lehrer

[57] ABSTRACT

An apparatus for filling a plurality of containers with a predetermined amount of a particulate or granular material. The apparatus comprises a hopper for holding a supply of material. The hopper has an upper end, a lower end and at least one tapered side wall. A plurality of discharge nozzle assemblies extend downwardly from the lower end of the hopper. A transport assembly is provided for uniformly transporting each of the containers directly under a corresponding one of the discharge nozzle assemblies. A frame supports the hopper above the transport assembly. Each of the discharge nozzle assemblies has an auger mounted thereabove for assisting the delivery of material to the same. Each of the discharge nozzle assemblies also includes a valve which is adapted to open and close the open bottom end of a corresponding discharge nozzle assembly in order to control the flow of material from the nozzle.

6 Claims, 3 Drawing Sheets

2
52
10
48
28
32
12
44
46
30
40
42
56
20
14
70
18
16
72
26
100
78
80
3
3
22
82
45
47
2

52
48
36
50
28
12
34
74
32
56
18
70
73
72
76
100
79
4
80
75
78
82
22
47
4
45

APPARATUS FOR FILLING A PLURALITY OF CONTAINERS WITH PARTICULATE OR GRANULAR MATERIAL

CROSS-REFERENCE TO RELATED APPLICATION

This application claims the benefit of U.S. Provisional Patent Application Ser. No. 60/042,844, filed Mar. 31, 1997.

BACKGROUND OF THE INVENTION

The present invention is directed toward an apparatus for filling a plurality of containers with particulate or granular material and, more particularly, to such an apparatus which includes a hopper with a tapered front wall, a plurality of discharge nozzle assemblies, and a transport assembly adapted to move each of the containers into proper position directly beneath a corresponding one the discharge nozzle assemblies.

There are many known devices for filling containers with particulate or granular material. Such devices typically include a hopper into which the material is poured. The material exits the hopper from one or more discharge nozzle assemblies which extend downwardly from the bottom of the hopper. The hoppers associated with these devices often have a circular cross-section. While such a hopper configuration is satisfactory for discharging material when there is only one discharge nozzle, it does not promote the uniform withdrawal of material when there are a plurality of discharge nozzle assemblies associated therewith.

The discharge nozzle assemblies of the filling devices of the type described above often cannot operate properly if material from the hopper is not properly delivered to the nozzle assembly. Even further, such filling devices do not include means for properly transporting each of the containers directly underneath a corresponding one of the discharge nozzle assemblies.

SUMMARY OF THE INVENTION

The present invention is designed to overcome the deficiencies of the prior art discussed above. It is an object of this invention to provide an apparatus for simultaneously and uniformly filling a plurality of containers with particulate or granular material.

It is a further object of the invention to provide such an apparatus which includes means for more uniformly providing the discharge nozzle assemblies with the particulate and/or granular material.

It is yet another object of the invention to provide such an apparatus which readily transports each of the containers into a proper position beneath a corresponding one of the discharge nozzle assemblies.

In accordance with the illustrative embodiments, demonstrating features and advantages of the present invention, there is provided an apparatus for filling a plurality of containers with a predetermined amount of a particulate or granular material. The apparatus comprises a hopper for holding a supply of material. The hopper has an upper end, a lower end and at least one tapered side wall. A plurality of discharge nozzle assemblies extend downwardly from the lower end of the hopper. A transport assembly is provided for transporting each of the containers directly under a corresponding one of the discharge nozzle assemblies. A frame supports the hopper above the transport assembly. Each of the discharge nozzle assemblies has an auger mounted thereabove for supplying material to the same.

Each of the discharge nozzle assemblies also includes a valve which is adapted to open and close the open bottom end of the corresponding discharge nozzle assembly in order to control the flow of material from the nozzle.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred, it being understood that the invention is not intended to be limited to the precise arrangements and instrumentalities shown.

DETAILED DESCRIPTION OF THE PREFERRED EMBODIMENT

Figure 1:
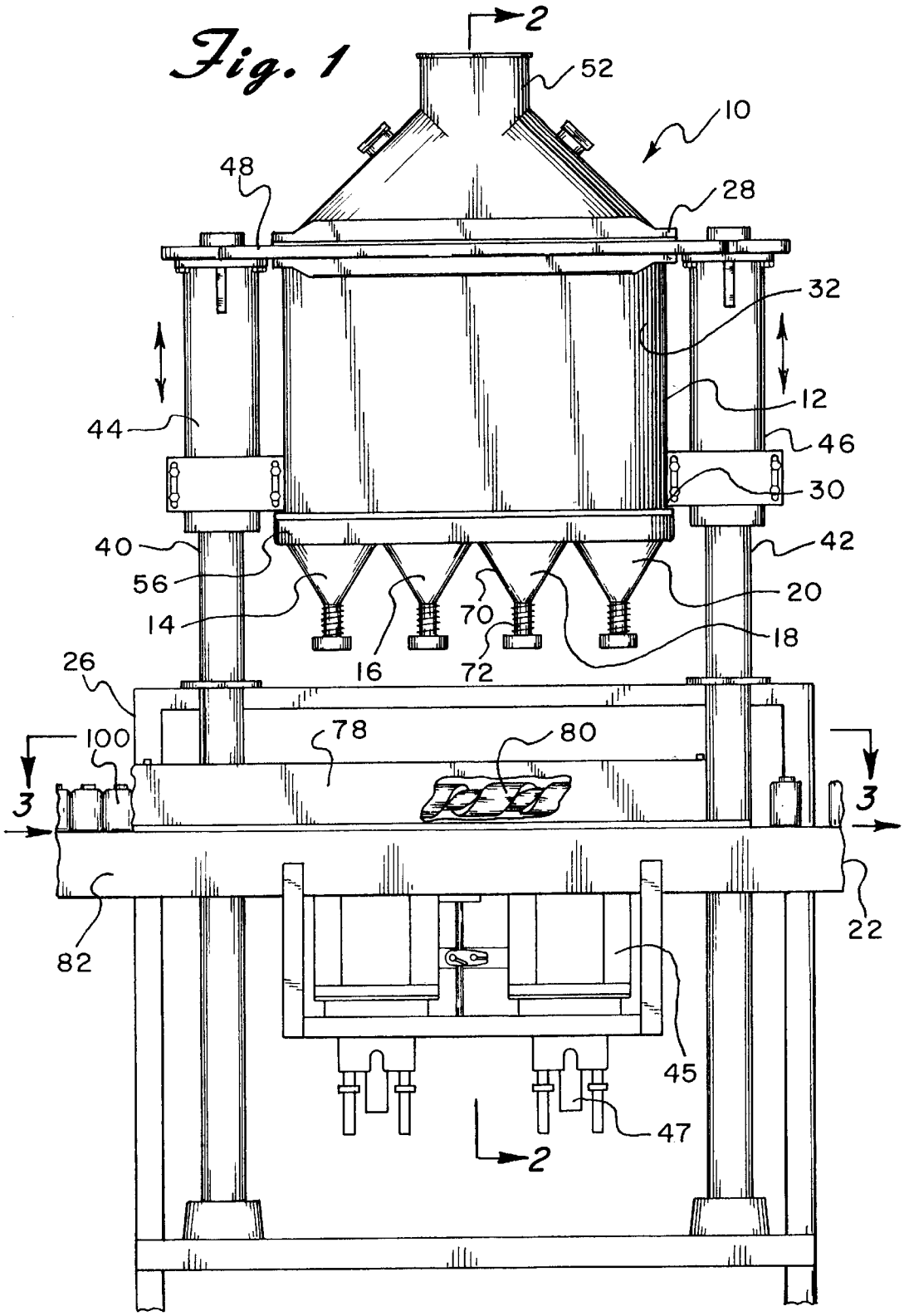
FIG. 1 is a front elevational view of an apparatus according to the present invention.

Referring now to the drawings in detail wherein like reference numerals have been used throughout the various figures to designate like elements, there is shown in FIG. 1 an apparatus for filling a plurality of containers with particulate or granular material constructed in accordance with the principles of the present invention and designated generally as 10.

The apparatus 10 essentially includes a hopper 12, a plurality of discharge nozzle assemblies 14, 16, 18, and 20 extending downwardly from the hopper, a transport assembly 22, and a support frame 26.

Figure 5:
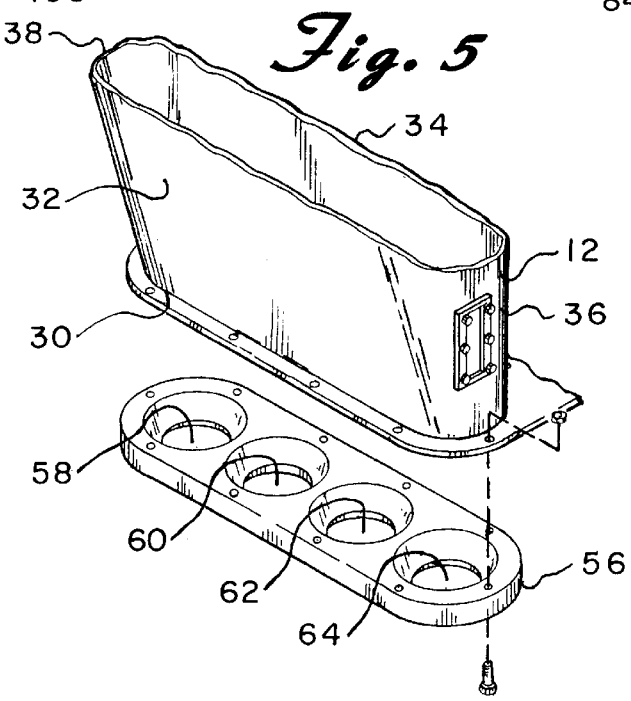
FIG. 5 is a partial perspective view of a hopper of the filling apparatus with a connector plate shown exploded therefrom.

As shown most clearly in FIG. 5, the hopper 12 has an upper end 28, a lower end 30, a tapered front wall 32, a rear wall 34, and a pair of opposing side walls 36 and 38. The hopper has a substantially rectangular cross-section. The tapered front wall 32 facilitates the uniform flow of material toward the discharge nozzle assemblies as more fully described below.

The frame 26 supports the hopper 12. The frame includes two spaced apart upright members 40 and 42 (FIG. 1). Each of the upright members 40 and 42 has a pneumatic cylinder 44 and 46, respectively, mounted for vertical movement along the upper portion of the same. An upper connecting member 48 extends between the upright members. Each side of the upper connecting member is secured to a corresponding one of the pneumatic cylinders 44 and 46 and, therefore, moves along the vertical plane with the pneumatic cylinders. The upper end 28 of the hopper 12 is connected to the upper connecting member 48 between the upright members 40 and 42 of the frame. In an alternate embodiment, the cylinders 44 and 46 could be used to make vertical height adjustments of the hopper assembly and a series of air cylinders 45 and associated container lifting bars 47 located beneath the transport assembly 22 could be used to raise the containers 100 toward the nozzle assembly 18.

Figure 2:
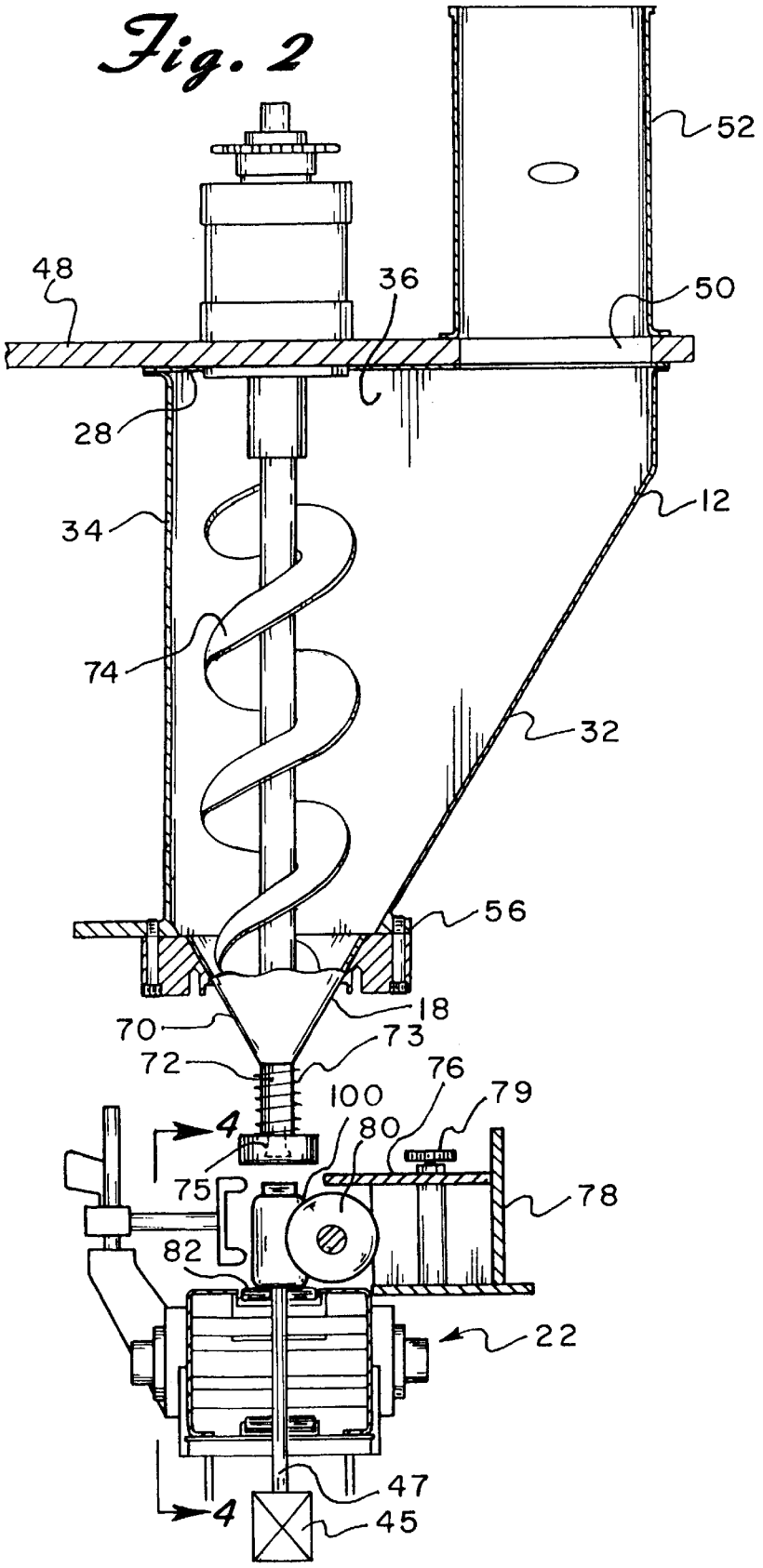
FIG. 2 is a partial cross-sectional view taken along lines 2—2 of FIG. 1.

The upper connecting member 48 has an opening 50 therein as shown in FIG. 2. In the preferred embodiment, an input spout 52 is secured over the opening 50 in the upper connecting member 48.

A lower connector plate 56 is preferably secured to the lower end 30 of the hopper 12 (FIGS. 1, 2 and 5). The lower connector plate includes a plurality of openings therein 58, 60, 62, and 64. Each of the discharge nozzle assemblies 14,16, 18, and 20 is secured to and extends downwardly from a corresponding one of the openings in the lower connector plate.

Each discharge nozzle assembly is substantially identical to the other assemblies. Accordingly, only one discharge nozzle assembly will be described in detail; it being understood that the description applies equally to the other discharge nozzle assemblies.

Discharge nozzle assembly 18 includes a frusto conical portion 70 extending downwardly from opening 62 in the connector plate 56 (FIG. 2). A tubular member 72 extends downwardly from the conical portion 70. The tubular member 72 is mounted for vertical movement in the frusto conical portion 70 against the restoring force of a spring 73 and terminates in an open bottom end. A valve means 75 which includes a valve stem and a valve seat is fixedly mounted in the discharge nozzle assembly 18. The tubular member is adapted to be moved from a first position, wherein the valve seat seals the open bottom end to prevent material from exiting the same, to a second position, wherein there is space between the valve seat and the open bottom end of the tubular member so that material can flow therefrom.

The discharge nozzle assembly 18 is not, per se, new in the art. Substantially any known nozzle that works in the manner indicated may be utilized. Nozzles of this type are described, for example, in U.S. Pat. Nos. 2,820,579 and 5,154,212 the subject matter of each being incorporated herein by reference.

Each discharge nozzle assembly such as discharge nozzle assembly 18 further includes a screw auger 74 axially aligned therewith in the hopper 12 thereabove. The lowermost portion of the auger 74 extends into the frusto conical portion 70 of the nozzle assembly. When the screw augers are actuated, they rotate in order to break up any material that may be clumped together and assist in the delivery of free flowing material to the discharge nozzle assemblies.

Figure 3:
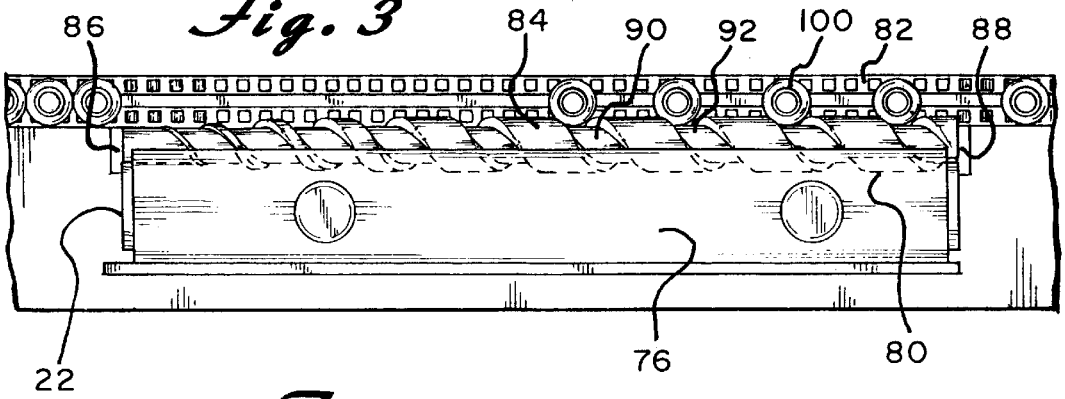
FIG. 3 is a top plan view taken along lines 3—3 of FIG. 1.
Figure 4:
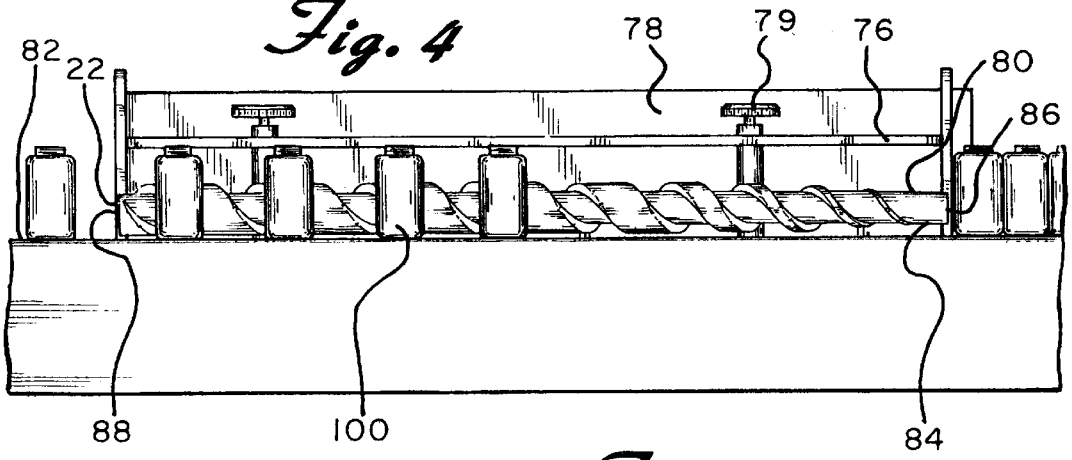
FIG. 4 is a partial rear elevational view of the transport assembly of the present invention.

The transport assembly 22 includes a feed screw assembly 80 and a conveyor 82. The feed screw assembly 80 is mounted for rotation adjacent and above one side of the conveyor 82. The feed screw assembly 80 includes a shaft 84 with an input end 86 and an output end 88 (FIGS. 3 and 4). The shaft 84 has a plurality of threads formed therein such as shown at 90 and 92 in FIG. 3. Each thread has a predetermined pitch which increases from the input end to the output end. The conveyor 82 is adapted to transport a row of containers across the same and the feed screw assembly is adapted to engage each of the containers between the threads of the shaft and position each of the containers directly under a corresponding one of the discharge nozzle assemblies as more fully described below. For safety reasons and to protect workers from contacting the rotating feed screw, a cover member 76 with a front wall 78 are positioned along the length thereof. Preferably the cover member 76 and front wall 78 are made of transparent material so that a worker can observe the filling operation. The cover member can, however, be removed by unscrewing the knobs or handles 79 which secure them in place.

In order to facilitate an understanding of the principles associated with the foregoing apparatus, its operation will now be briefly described. A supply of particulate or granular material is poured into input spout 52 so that the hopper 12 is filled with the same. Thereafter, the conveyor 82 and the feed screw assembly 80 are actuated by means known in the art. A plurality of containers, such as shown at 100, are then placed on top of the conveyor 82. As each container 100 is moved along the conveyor 82, its side is contacted by the rotating feed screw assembly 80. Specifically, the rotation of the feed screw assembly causes each container to be moved from the input end 86 toward the output end 88 of the shaft 84. As each container is moved, it passes from thread to thread. Since the pitch of adjacent threads increases from the input end to the output end of the shaft, the speed at which the containers move increases as they approach the output end of the shaft of the feed screw assembly. As a result, although the containers enter the input end 86 of the feed screw in a single row and in close proximity to each other as shown in FIG. 3, they spread apart as they are moved by the variable pitch of the feed screw until the are properly positioned along the length thereof as is also shown in FIG. 3.

When a different container is positioned directly under a corresponding one of the discharge nozzle assemblies 16, 18, 20 and 22, the conveyor 82 and the feed screw assembly 80 are turned off. Thereafter, the air cylinders 45 are actuated to raise the lifting bars 47 and hence the containers 100 upwardly to engage the discharge nozzles 18. Alternatively, the pneumatic cylinders 44 and 46 could be actuated to lower the upper connecting member 48 and, therefore, the hopper 12 and the discharge nozzle assemblies, which are associated therewith.

In either case, as each discharge nozzle assembly comes into contact with a corresponding container 100 positioned directly thereunder, the container 100 contacts the spring loaded tubular member 72 and forces the same upward thereby creating a space between the valve seat of the valve and the bottom end of the tubular member (FIG. 2). Accordingly, material is then free to flow into the corresponding container.

When each of the containers is filled with the requisite amount of material, the pneumatic cylinders 44 or 45 are once again actuated to either lower the containers or to lift the hopper and discharge assemblies upwardly. The restoring force of the spring associated with each nozzle assembly causes the same to move downward so that the valve seat once again closes off the bottom end of the tubular member to prevent material from exiting the same. The conveyor 82 and feed screw assembly 80 are then actuated to pass the filled containers to a desired location and to simultaneously position new containers under the nozzle assemblies.

The present invention may be embodied in other specific forms without departing from the spirit or essential attributes thereof and accordingly reference should be made to the appended claims rather than to the foregoing specification as indicating the scope of the invention.

I claim:

1. An apparatus for simultaneously and uniformly filling a plurality of containers with particulate or granular material comprising:

a hopper for holding a supply of material, said hopper having an upper end, a lower end and at least one tapered side wall;

a plurality of discharge nozzle assemblies extend downwardly from the lower end of said hopper, each of said discharge nozzle assemblies including an auger mounted thereabove for supplying material to the same and a valve at the lowermost end thereof adapted to open and close the open bottom end of the corresponding discharge nozzle assembly in order to control the flow of material from the same;

transport means for transporting containers to positions directly under a corresponding one of said discharge nozzle assemblies, said transport means including a first conveyor means for moving a row of containers toward said discharge nozzle assemblies and a second conveyor means in the form of a feed screw assembly for moving the containers from the first conveyor means to positions directly under said discharge nozzle assemblies, and means for moving said containers located directly under said discharge nozzle assemblies and said discharge nozzle assemblies vertically toward each other to activate said valves to fill said containers with said particulate or granular material.

2. The apparatus as claimed in claim 1 wherein said feed screw assembly spaces said containers apart from each other as it moves them to positions directly under said discharge nozzle assemblies.

3. The apparatus as claimed in claim 2 wherein said feed screw assembly includes a feed screw with an input end and an output end and having a thread thereon extending substantially the length of said screw from said input end to said output end.

4. The apparatus as claimed in claim 3 wherein the pitch of said thread increases from said input end to said output end of said screw.

5. The apparatus as claimed in claim 1 wherein said means for moving said containers and said discharge nozzle assemblies vertically toward each other includes means for moving said containers vertically upwardly toward said discharge nozzle assemblies.

6. The apparatus as claimed in claim 1 wherein said means for moving said containers and said discharge nozzle assemblies vertically toward each other includes means for moving said discharge nozzle assemblies vertically downwardly toward said containers.

* * * * *